US008823548B2

(12) United States Patent
Johnson et al.

(10) Patent No.: US 8,823,548 B2
(45) Date of Patent: Sep. 2, 2014

(54) CONTROL OF TRAFFIC SIGNAL PHASES

(75) Inventors: David Randal Johnson, Oakdale, MN (US); Kevin Eichhorst, Owatonna, MN (US)

(73) Assignee: Global Traffic Technologies, LLC, St. Paul, MN (US)

( * ) Notice: Subject to any disclaimer, the term of this patent is extended or adjusted under 35 U.S.C. 154(b) by 1022 days.

(21) Appl. No.: 12/815,790

(22) Filed: Jun. 15, 2010

(65) Prior Publication Data

US 2011/0304476 A1 Dec. 15, 2011

(51) Int. Cl.

| | |
|---|---|
| ***G08G 1/07*** | (2006.01) |
| ***G08G 1/087*** | (2006.01) |
| ***G08G 1/01*** | (2006.01) |
| ***G08G 1/0965*** | (2006.01) |

(52) U.S. Cl.

CPC ..... *G08G 1/087* (2013.01); *G08G 1/0104* (2013.01); *G08G 1/07* (2013.01); *G08G 1/0965* (2013.01)

USPC ..... 340/906; 340/988; 340/907; 340/435; 340/902; 701/117

(58) Field of Classification Search

CPC ..... G08G 1/087; G08G 1/0104; G08G 1/67; G08G 1/0965; G01C 21/26

USPC ..... 340/907, 906, 908, 436, 909, 910, 911, 340/924, 901; 701/117, 118, 423, 515; 8/907, 906, 908, 436, 435, 909, 910, 8/911, 924, 901, 988, 902, 916

See application file for complete search history.

(56) References Cited

U.S. PATENT DOCUMENTS

| | | | | |
|---|---|---|---|---|
| 4,162,477 | A * | 7/1979 | Munkberg | 340/906 |
| 5,172,113 | A * | 12/1992 | Hamer | 340/907 |
| 5,187,373 | A * | 2/1993 | Gregori | 250/551 |
| 5,187,476 | A * | 2/1993 | Hamer | 340/906 |
| 5,202,683 | A * | 4/1993 | Hamer et al. | 340/906 |
| 5,539,398 | A * | 7/1996 | Hall et al. | 340/907 |
| 5,602,739 | A * | 2/1997 | Haagenstad et al. | 701/117 |
| 6,064,319 | A * | 5/2000 | Matta | 340/917 |
| 6,243,026 | B1 * | 6/2001 | Jones et al. | 340/906 |
| 6,281,808 | B1 * | 8/2001 | Glier et al. | 340/933 |
| 6,417,782 | B1 * | 7/2002 | Darnall | 340/902 |
| 6,621,420 | B1 * | 9/2003 | Poursartip | 340/907 |
| 6,985,090 | B2 * | 1/2006 | Ebner et al. | 340/907 |

(Continued)

FOREIGN PATENT DOCUMENTS

| | | |
|---|---|---|
| GB | 1 253 804 | 11/1971 |
| JP | 2000-227992 | 8/2000 |

(Continued)

*Primary Examiner* — Hoi Lau

(74) *Attorney, Agent, or Firm* — Crawford Maunu PLLC

(57) ABSTRACT

Controlling a traffic signal phase at one or more intersections. A control system at an intersection is configured to operate in one of a first mode or a second mode. While operating the controller in the first mode, in response to a transit priority signal received by the control system from a vehicle assigned transit priority, a green phase of the traffic signal is extended in favor of the vehicle assigned transit priority. While operating the control system in the second mode, in response to a transit priority signal received by the control system from the vehicle assigned transit priority, a current non-green phase of the traffic signal is preempted to a green phase in favor of the vehicle assigned transit priority.

21 Claims, 10 Drawing Sheets

(56) References Cited

U.S. PATENT DOCUMENTS

| | | | | |
|---|---|---|---|---|
| 7,307,547 | B2 * | 12/2007 | Schwartz | 340/907 |
| 7,333,028 | B2 * | 2/2008 | Schwartz | 340/907 |
| 7,417,560 | B2 * | 8/2008 | Schwartz | 340/906 |
| 7,515,064 | B2 * | 4/2009 | Schwartz | 340/902 |
| 7,808,401 | B1 * | 10/2010 | Schwartz et al. | 340/906 |
| 7,952,491 | B2 * | 5/2011 | Schwartz et al. | 340/902 |
| 7,982,631 | B2 * | 7/2011 | Schwartz et al. | 340/815.45 |
| 8,072,346 | B2 * | 12/2011 | Hall et al. | 340/815.45 |
| 8,325,062 | B2 * | 12/2012 | Johnson | 340/909 |
| 8,344,908 | B2 * | 1/2013 | Johnson | 340/906 |
| 2005/0264431 | A1 * | 12/2005 | Bachelder | 340/906 |
| 2007/0008173 | A1 * | 1/2007 | Schwartz | 340/902 |
| 2007/0008174 | A1 * | 1/2007 | Schwartz | 340/902 |
| 2011/0068951 | A1 * | 3/2011 | Schwartz et al. | 340/906 |
| 2011/0084853 | A1 * | 4/2011 | Johnson | 340/906 |
| 2011/0084854 | A1 * | 4/2011 | Johnson | 340/909 |
| 2011/0109477 | A1 * | 5/2011 | Edwardson et al. | 340/906 |
| 2011/0115409 | A1 * | 5/2011 | Schwartz et al. | 315/297 |
| 2011/0115645 | A1 * | 5/2011 | Hall et al. | 340/907 |
| 2011/0169661 | A1 * | 7/2011 | Eichhorst | 340/906 |
| 2011/0193722 | A1 * | 8/2011 | Johnson | 340/906 |
| 2011/0234423 | A1 * | 9/2011 | Edwardson | 340/906 |
| 2011/0304476 | A1 * | 12/2011 | Johnson et al. | 340/906 |

FOREIGN PATENT DOCUMENTS

| | | |
|---|---|---|
| JP | 2008-305090 | 12/2008 |
| JP | 2010-102476 | 5/2010 |
| WO | WO 2006/138364 | 12/2006 |

* cited by examiner

CONTROL OF TRAFFIC SIGNAL PHASES

FIELD OF THE INVENTION

The embodiments of the present invention generally relate to managing preemption of traffic control signals.

BACKGROUND

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have in the past typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle.

Traffic control preemption systems assist authorized vehicles (police, fire and other public safety or transit vehicles) through signal-controlled intersections by making a preemption request to the intersection controller. The controller will respond to the request from the vehicle by changing the intersection lights to green in the direction of the approaching vehicle. This system improves the response time of public safety personnel, while reducing dangerous situations at intersections when an emergency vehicle is trying to cross on a red light. In addition, speed and schedule efficiency can be improved for transit vehicles.

There are presently a number of known traffic control preemption systems that have equipment installed at certain traffic signals and on authorized vehicles. One such system in use today is the OPTICOM® system. This system utilizes a high power strobe tube (emitter), which is located in or on the vehicle, that generates light pulses at a predetermined rate, typically 10 Hz or 14 Hz. A receiver, which includes a photodetector and associated electronics, is typically mounted on the mast arm located at the intersection and produces a series of voltage pulses, the number of which are proportional to the intensity of light pulses received from the emitter. The emitter generates sufficient radiant power to be detected from over 2500 feet away. The conventional strobe tube emitter generates broad spectrum light. However, an optical filter is used on the detector to restrict its sensitivity to light only in the near infrared (IR) spectrum. This minimizes interference from other sources of light.

Intensity levels are associated with each intersection approach to determine when a detected vehicle is within range of the intersection. Vehicles with valid security codes and a sufficient intensity level are reviewed with other detected vehicles to determine the highest priority vehicle. Vehicles of equivalent priority are selected in a first come, first served manner. A preemption request is issued to the controller for the approach direction with the highest priority vehicle travelling on it.

Another common system in use today is the OPTICOM GPS priority control system. This system utilizes a GPS receiver in the vehicle to determine location, speed and heading of the vehicle. The information is combined with security coding information that consists of an agency identifier, vehicle class, and vehicle ID and is broadcast via a proprietary 2.4 GHz radio.

An equivalent 2.4 GHz radio located at the intersection along with associated electronics receives the broadcasted vehicle information. Approaches to the intersection are mapped using either collected GPS readings from a vehicle traversing the approaches or using location information taken from a map database. The vehicle location and direction are used to determine on which of the mapped approaches the vehicle is approaching toward the intersection and the relative proximity to it. The speed and location of the vehicle is used to determine the estimated time of arrival (ETA) at the intersection and the travel distance from the intersection. ETA and travel distances are associated with each intersection approach to determine when a detected vehicle is within range of the intersection and therefore a preemption candidate. Preemption candidates with valid security codes are reviewed with other detected vehicles to determine the highest priority vehicle. Vehicles of equivalent priority are selected in a first come, first served manner. A preemption request is issued to the controller for the approach direction with the highest priority vehicle travelling on it.

With metropolitan wide networks becoming more prevalent, additional means for detecting vehicles via wired networks such as Ethernet or fiber optics and wireless networks such as Mesh or 802.11b/g may be available. With network connectivity to the intersection, vehicle tracking information may be delivered over a network medium. In this instance, the vehicle location is either broadcast by the vehicle itself over the network or it may be broadcast by an intermediary gateway on the network that bridges between, for example, a wireless medium used by the vehicle and a wired network on which the intersection electronics resides. In this case, the vehicle or an intermediary reports, via the network, the vehicle's security information, location, speed and heading along with the current time on the vehicle, intersections on the network receive the vehicle information and evaluate the position using approach maps as described in the Opticom GPS system. The security coding could be identical to the Opticom GPS system or employ another coding scheme.

SUMMARY

The various embodiments provide methods and systems for controlling a traffic signal phase at one or more intersections. In one embodiment, a method includes configuring a control system at an intersection to operate in one of a first mode or a second mode. While operating the controller in the first mode, and in response to a transit priority signal received by the control system from a vehicle assigned transit priority, a green phase of the traffic signal is extended in favor of the vehicle assigned transit priority. While operating the control system in the second mode, and in response to a transit priority signal received by the control system from the vehicle assigned transit priority, a current non-green phase of the traffic signal is preempted to a green phase in favor of the vehicle assigned transit priority.

In another embodiment, a system is provided for controlling a traffic signal phase at an intersection. The system includes a control system at an intersection. The control system is configurable to operate in one of a first mode or a second mode. Two or more traffic signals are coupled to the control system. The control system is configured to extend, in response to a transit priority signal received from a vehicle assigned transit priority while the control system is operating in the first mode, a green phase of one of the two or more traffic signals in favor of the vehicle assigned transit priority. The control system is further configured to preempt, in response to a transit priority signal received by the control system from the vehicle assigned transit priority while the control system is operating the control system in the second mode, a current non-green phase of the one of the two or more traffic signals to a green phase in favor of the vehicle assigned transit priority.

A system for controlling traffic signal phases of respective sets of two or more traffic signals at a plurality of intersections is provided in another embodiment. The system includes a management system and a plurality of control systems at the plurality of intersections, respectively. Each control system is coupled to the management system and is individually configurable via the management system to operate in one of a first mode or a second mode. Each control system is coupled to one of the respective sets of two or more traffic signals. Each control system is configured to extend, in response to a transit priority signal received from a vehicle assigned transit priority while the control system is operating in the first mode, a green phase of one traffic signal of the respective set of two or more traffic signals in favor of the vehicle assigned transit priority. Each control system is further configured to preempt, in response to a transit priority signal received by the control system from the vehicle assigned transit priority while the control system is operating the control system in the second mode, a current non-green phase of the one traffic signal of the respective set of two or more traffic signals to a green phase in favor of the vehicle assigned transit priority.

The above summary of the present invention is not intended to describe each disclosed embodiment of the present invention. The figures and detailed description that follow provide additional example embodiments and aspects of the present invention.

BRIEF DESCRIPTION OF THE DRAWINGS

Other aspects and advantages of the invention will become apparent upon review of the Detailed Description and upon reference to the drawings in which.

DETAILED DESCRIPTION

The embodiments of the present invention provide an evacuation mode used in controlling the traffic signal phase at one or more intersections. In the evacuation mode, transit vehicles, for example buses, are permitted to preempt a traffic signal phase as compared to a normal operating mode in which transit vehicles are not permitted to preempt a traffic signal phase. A request by a transit vehicle during the normal operating mode may cause a green phase of the traffic signal to be extended if the bus is traveling in the direction having the green phase. However, a request by a transit vehicle during the normal operating mode will not result in preemption of a non-green phase in favor of the transit vehicle. The evacuation mode allows transit vehicles to preempt the traffic signal phase for selected events. Allowing transit vehicles to preempt traffic signal phases during evacuation mode aids in moving a large volume of traffic in a desired direction. For example, preceding or following an event in which a large number of people need to move to or from a certain geographic area, the evacuation mode may be activated to give transit vehicles traveling to or from the event area the ability to preempt the phase of a traffic signal.

Figure 1:
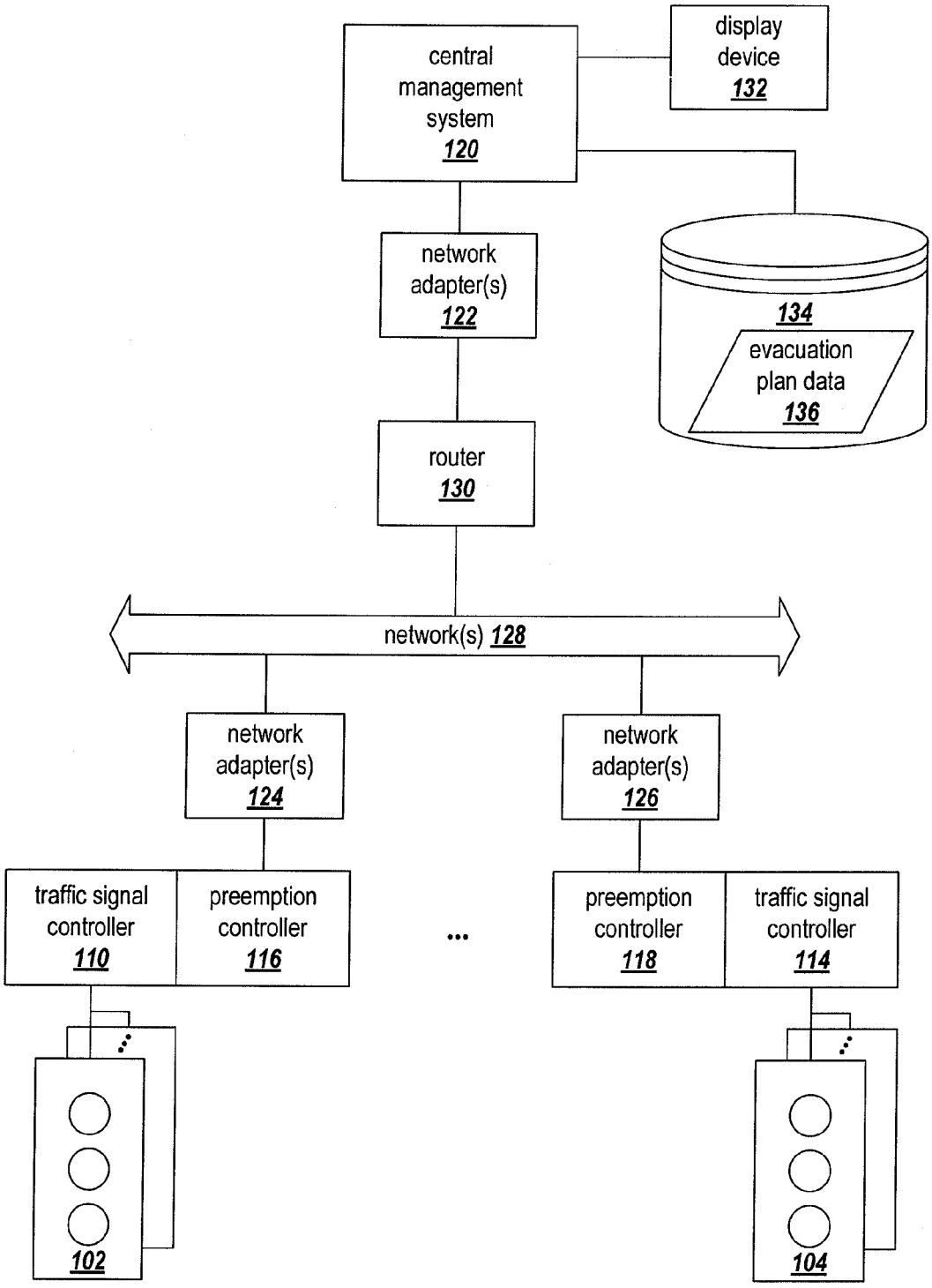
FIG. 1 is a block diagram of a system for monitoring traffic signal preemption in accordance with one or more embodiments of the invention.

FIG. 1 is a block diagram of a system for monitoring traffic signal preemption in accordance with one or more embodiments of the invention. Traffic lights 102 and 104 at intersections with preemption controllers are coupled to traffic signal controllers 110 and 114, respectively. Traffic signal controllers 110 and 114 are connected to respective preemption controllers 116 and 118. The combination of the preemption controller and the traffic signal controller form a control system for overall control of the phases of the traffic lights at an intersection. A central management system 120 and the preemption controllers are respectively coupled to network adapters 122, 124, and 126 for communication over a network 128. In various embodiments, a router or a network switch, as shown by router 130, may be coupled between the network adapter and the network. It is understood the central management system 120 and the preemption controllers 116 and 118 may be connected through more than one network, coupled by additional switches and routing resources, including a connection over the Internet.

It will be recognized that numerous network transfer protocols may be used to establish, maintain, and route connections including: TCP/IP, UDP, NFS, ESP, SPX, etc. It is also understood that network transfer protocols may utilize one or more lower layers of protocol communication such as ATM, X.25, or MTP, and on various physical and wireless networks such as, Ethernet, ISDN, ADSL, SONET, IEEE 802.11, V.90/v92 analog transmission, etc.

The central management system 120 is additionally coupled to display device 132 and to retentive storage device 134. The display device is used by the central management system in interacting with a user for configuring and controlling evacuation plans, which allow transit vehicles to selectively preempt traffic signals just as emergency vehicles are permitted to preempt traffic signals. Along with other data, the retentive storage device stores evacuation plan data 136.

In one embodiment that implements evacuation plans, a preemption controller supports two modes, a normal mode and an evacuation mode. In the normal mode, preemption requests from emergency vehicles are allowed to preempt the phase of a traffic signal, for example, change the traffic signal from red to green in the direction of travel of the emergency vehicle. For a transit vehicle, such as a bus, a preemption request from the transit vehicle will not preempt the phase of a traffic signal while the preemption controller is operating in a normal mode. Rather, in the normal mode if the traffic signal is currently in a green phase in the direction in which the transit vehicle is traveling, then the green phase may be extended for the transit vehicle. But if the traffic signal is currently in a red phase in the direction in which the transit vehicle is traveling, then a preemption request from a transit vehicle will not result in preemption of the traffic signal when the preemption controller is in normal mode.

In evacuation mode, a preemption request from a transit vehicle may be permitted to preempt the phase of a traffic signal. That is, a preemption request from a transit vehicle may preempt the phase of a traffic signal just as emergency vehicles are allowed to preempt the phase of the traffic signal. However, an emergency vehicle will still have priority over a transit vehicle if both have submitted preemption requests but in different directions.

In one embodiment, the central management system 120 establishes connections with preemption controllers 116 and 118 at selected intersections, and the central management system configures each preemption controller to operate in either the normal mode or the evacuation mode. While operating the preemption controller in the normal mode, in response to a preemption request from a transit vehicle, a green phase of the traffic signal may be extended in favor of the transit vehicle if the transit vehicle is traveling in the direction controlled by the green phase. A preemption request from a transit vehicle may also be referred to as a transit priority signal. While operating the preemption controller in the evacuation mode, in response to a preemption request from a transit vehicle, a current non-green phase of the traffic signal phase may be preempted to a green phase in favor of the transit vehicle. Also in the evacuation mode, if the transit vehicle makes a preemption request and is traveling in the direction of the green phase, the green phase will be extended to allow the transit vehicle to pass through the intersection.

In another embodiment, vehicle identifiers may be used to control which transit vehicles are allowed to preempt traffic signals while preemption controllers are operating in evacuation mode. The central management system 120 may receive user input that specifies the desired transit vehicles to be allowed preemption in evacuation mode. These vehicle identifiers are provided to selected ones of the preemption controllers 116 and 118 when the preemption controllers are configured to operate in evacuation mode. In order for the phase of a traffic signal to be preempted by a transit vehicle while the preemption controller is operating in evacuation mode, the vehicle identifier of that vehicle must be configured into the preemption controller. It will be recognized that preemption requests issued from a vehicle generally indicate the vehicle identifier of the vehicle.

The preferred direction for evacuation priority is configured into the selected preemption controllers 116 and 118 in another embodiment. In some scenarios it may be desirable to allow preemption of the phase of traffic signals at an intersection in one direction but not for other directions. For example, during evacuation mode it may be desirable to allow preemption at selected intersections for southbound and northbound transit vehicles but not allow preemption for eastbound or westbound transit vehicles. The user may specify the direction in which preemption is allowed as input to the central management system 120. The central management system configures the selected preemption controllers 116 and 118 according to the user specified direction parameters. While operating in evacuation mode with a specified direction parameter, the preemption controller will deny a preemption request from a transit vehicle unless the transit vehicle is traveling in the specified direction.

In another embodiment the user may specify dates and times during which selected preemption controllers are to operate in evacuation mode. The central management system 120 automatically configures the selected preemption controllers 116 and 118 to operate in evacuation mode on the designated dates and at the designated times. In one embodiment, each preemption controller is configured with a timer that controls the duration of the evacuation mode, and the timer is configured based on the user-specified dates and times. In an alternative embodiment, the central management system may return the preemption controllers to normal mode after expiration of the user-specified dates and times. It will be appreciated that having each preemption controller control the expiration of the evacuation mode may be preferable where there is a possibility of interruptions in the communication between the central management system and the preemption controllers.

While operating in evacuation mode, each emergency vehicle maintains preemption priority over transit vehicles. That is, if during evacuation mode there are concurrent preemption requests from an emergency vehicle and from a transit vehicle, the preemption controller will select the preemption request from the emergency vehicle over the preemption request from the transit vehicle. For example, if the emergency vehicle is eastbound and the transit vehicle is southbound and the eastbound light is green, and the southbound light is red when the concurrent preemption requests are made, the eastbound light will stay green in servicing the preemption request from the emergency vehicle over the preemption request from the transit vehicle. If the emergency vehicle is eastbound and the transit vehicle is southbound and the eastbound light is red, and the southbound light is green when the concurrent preemption requests are made, the eastbound light will be turned to green and the southbound light turned red in servicing the preemption request from the emergency vehicle.

In another embodiment, the user may define evacuation plan data via the central management system 120. Generally, the evacuation plan data specifies those intersections for which the evacuation mode is to be activated. In various embodiments the evacuation plan data may further specify the direction for each intersection, start and stop dates and times for evacuation mode, and vehicle identifiers of those transit vehicles for which preemption may be granted. In another embodiment, there may be multiple evacuation plans, each with its own set of intersections, directions, start and stop dates and times, and vehicle identifiers.

Those skilled in the art will appreciate that various alternative computing arrangements, including one or more processors and a memory arrangement configured with program code, would be suitable for hosting the processes and data structures of the different embodiments of the present invention. In addition, program code that implements the processes may be provided via a variety of computer-readable storage media or delivery channels such as magnetic or optical disks or tapes, electronic storage devices, or as application services over a network. For example, central management system 120 may include one or more processors coupled to a memory/storage arrangement. The architecture of the computing arrangement depends on implementation requirements as would be recognized by those skilled in the art. The processor may be one or more general purpose processors, or a combination of one or more general purpose processors and suitable co-processors, or one or more specialized processors (e.g., RISC, pipelined, etc.). The memory/storage arrangement may be hierarchical storage as is commonly found in computing arrangements. Such hierarchical storage typically includes multiple levels of cache memory, a main memory, and local and/or remote persistent storage such as provided by magnetic disks (not shown). The memory/storage arrangement may include one or both of local and remote memory/ storage, remote storage being coupled to the processor arrangement via a local area network, for example. The processor arrangement executes software stored in the memory/storage arrangement, and reads data from and stores data to the memory/storage arrangement according to the processes described above. An operating system manages the resources of the computing arrangement.

Figure 2:
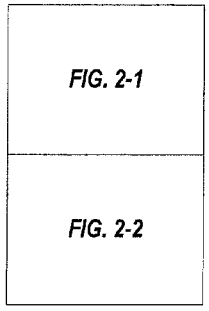
FIG. 2 is a flowchart of a generalized process for processing a preemption request by the preemption controller.
Figures 1, 2:
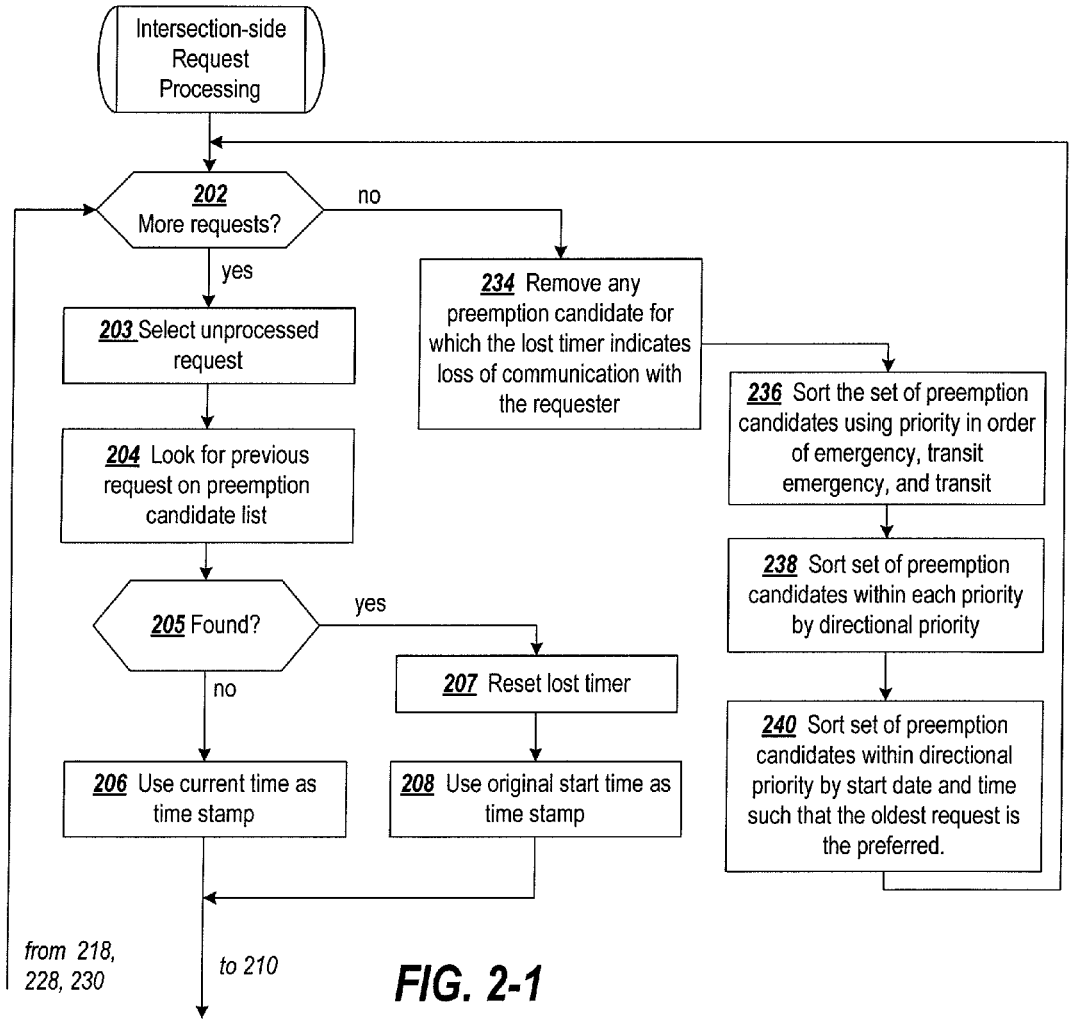
Figure 2:
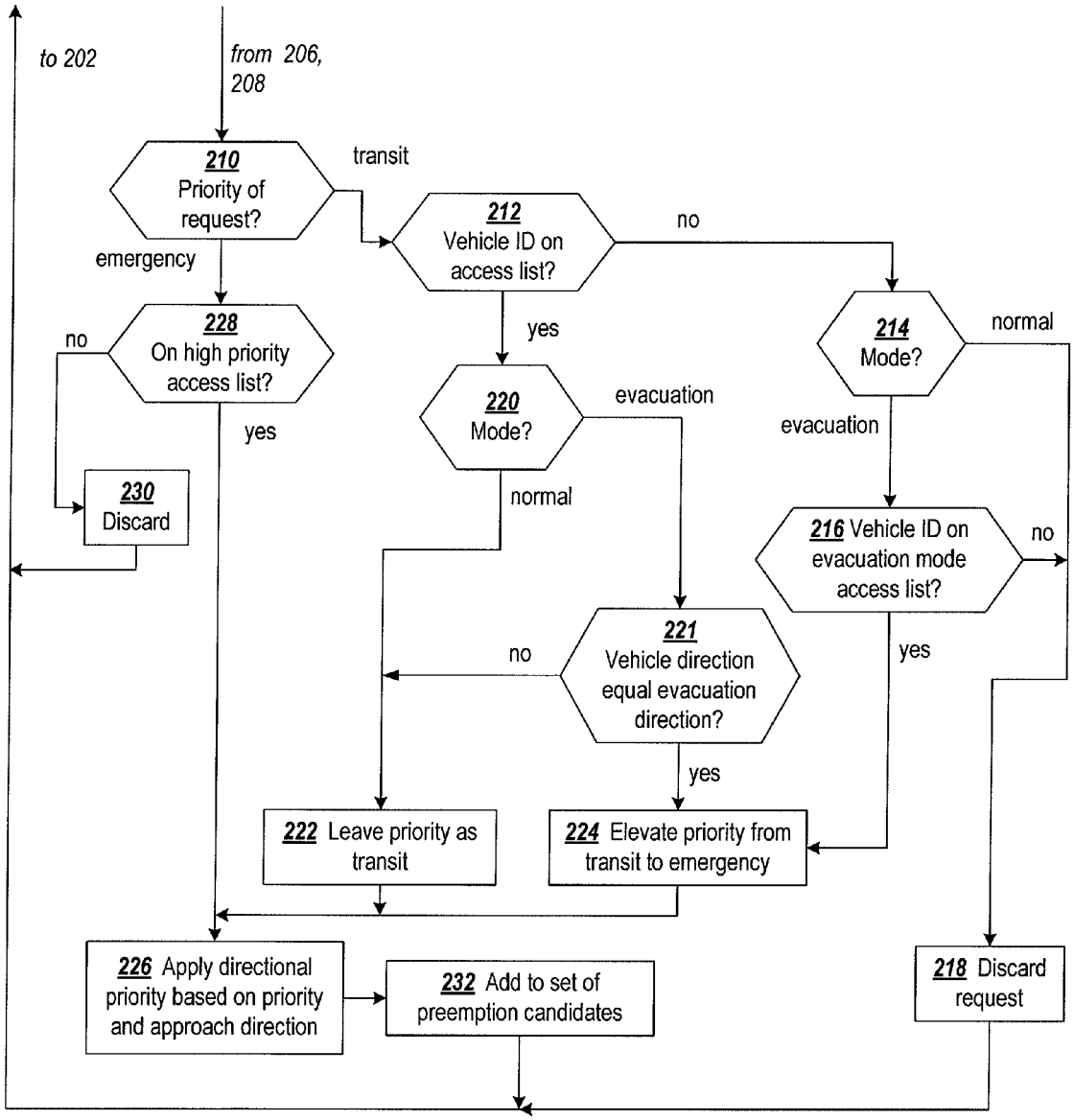
Figures 1, 3:
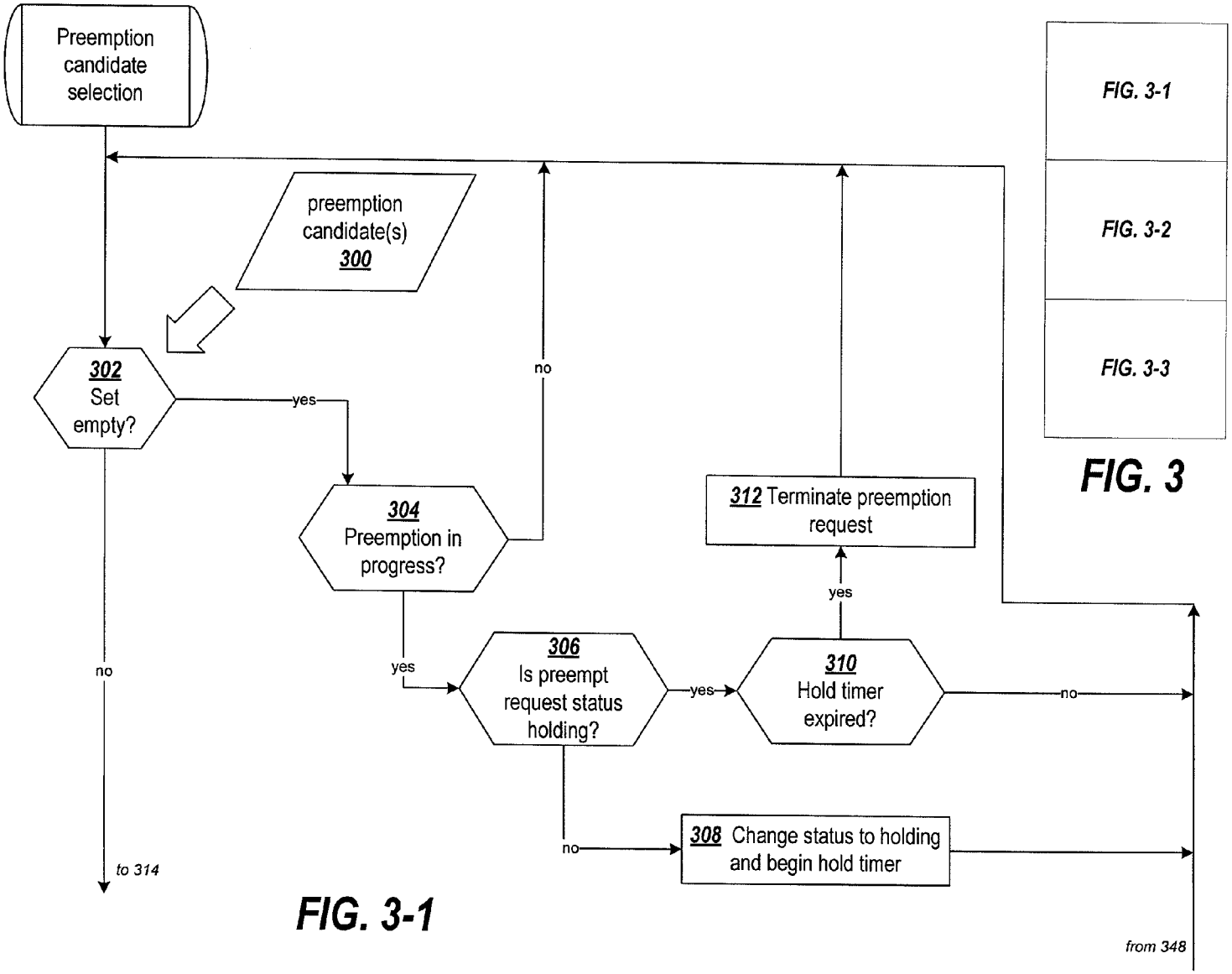
FIG. 3 shows the relationship between FIGS. 3-1, 3-2, and 3-3, which together form a flowchart of an example process for selecting one preemption candidate from multiple preemption candidates to preempt the traffic signal phase in accordance with an embodiment of the invention.
Figures 2, 3:
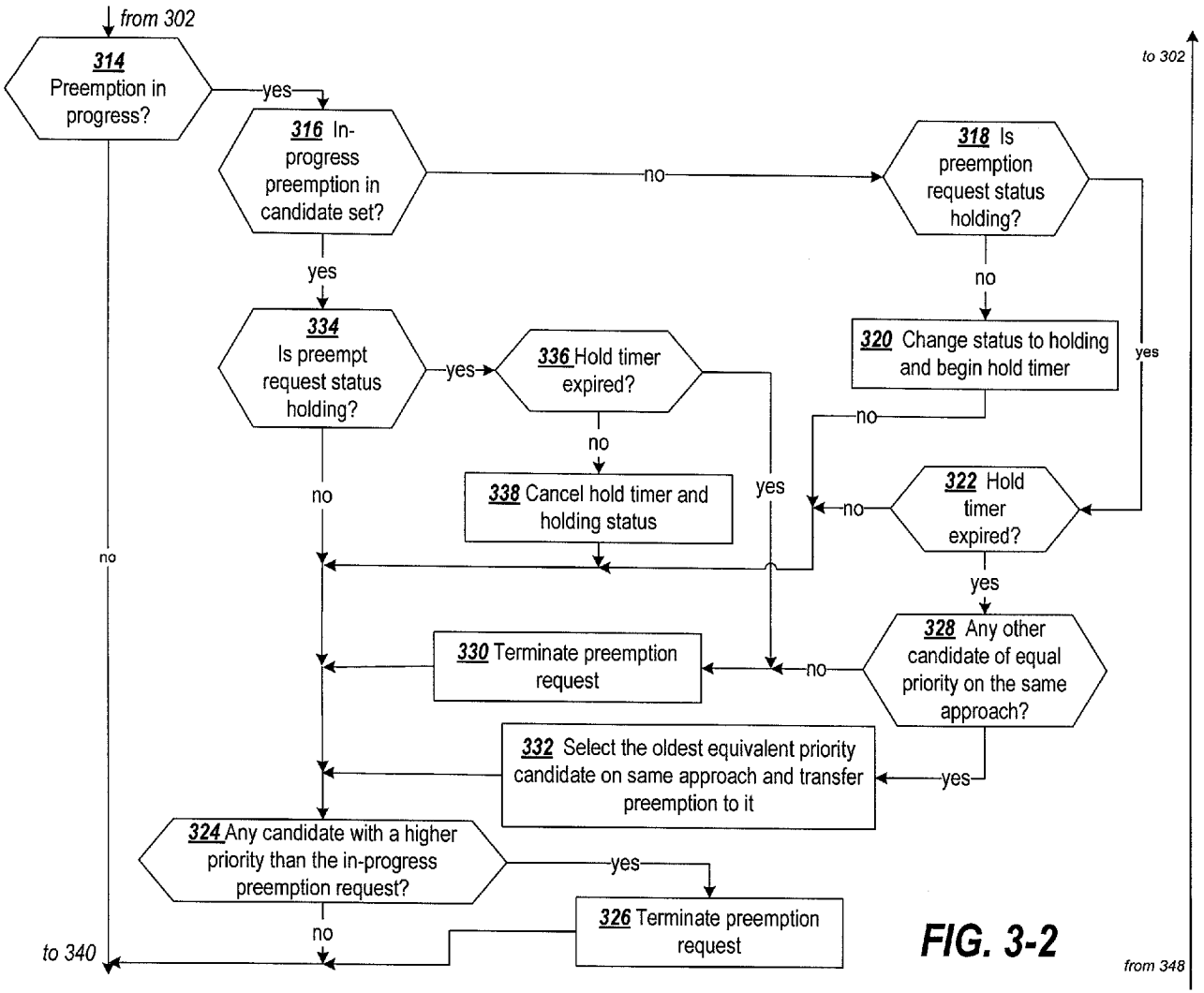
Figure 3:
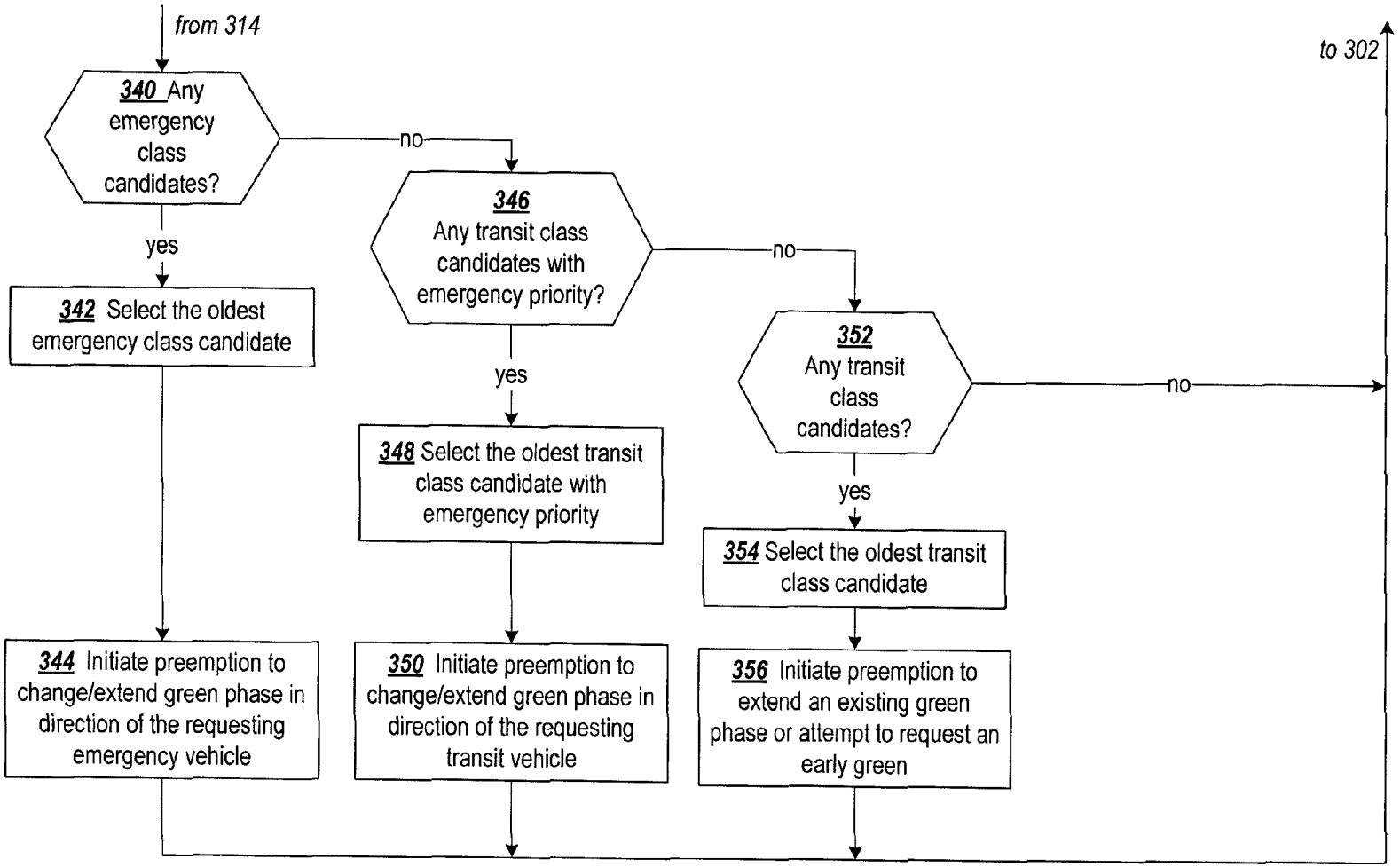

FIG. 2 shows the relationship between FIGS. 2-1 and 2-2, which together form a flowchart of a generalized process for processing a preemption request by the preemption controller. Generally, incoming preemption requests are processed into a set of preemption candidates in the process of FIGS. 2-1 and 2-2. The set of preemption candidates is further processed to select one preemption candidate for which preemption is to be granted as shown in FIGS. 3-1-3-3. The flowchart of FIGS. 2-1 and 2-2 shows how a preemption request from a transit vehicle is processed differently depending on whether the controller is operating in a normal mode or in an evacuation mode.

As long as there is a preemption request that has not been added to the set of preemption candidates, decision step 202 directs the process to step 203. At step 203, one of the unprocessed requests is selected, and step 204 looks for a previous request from the sender in the set of preemption candidates. If the request is not already on the preemption candidate list (decision step 205) the process continues to step 206 where the current time is assigned as the timestamp for the request. Otherwise, if the request is already in the set of preemption candidates, the lost timer is reset for that request at step 207. Note that the lost timer for a request is used in checking whether or not the signal was lost for the requester after the initial request had been sent. The original start time of the request is used as the time stamp for the request at step 208.

At decision step 210, the process checks the priority of the request. If the request has transit priority, the process continues to decision step 212. The process determines whether or not the vehicle identifier in the preemption request is on the general access list, which is configurable by the central management system 120. If the transit vehicle is not on the general access list, the process is directed to decision step 214 where the operating mode of the preemption controller is checked. If the preemption controller is operating in evacuation mode, the process checks whether or not the vehicle identifier of the transit vehicle is on the evacuation mode access list at step 216. If the transit vehicle is not identified on the evacuation mode list or the preemption controller is operating in normal mode (and the transit vehicle is not on the general access list), the preemption request is discarded at step 218, and the process returns to step 202 to process any further pending requests. Otherwise, if the transit vehicle is identified on the evacuation mode list, the priority of the preemption request is raised to emergency priority at step 224. If the transit vehicle is on the general access list (decision step 212), the operating mode is evacuation mode (decision step 220), and the direction of travel of the requesting vehicle is the same as the configured evacuation direction (decision step 221), the priority of the preemption request from the transit vehicle is raised to emergency priority at step 224. If the transit vehicle is on the general access list and the operating mode is normal, the priority of the preemption request is left as a transit priority at step 222.

If the priority of the preemption request is an emergency (decision step 210), decision step 228 checks whether or not the emergency vehicle is identified on the high priority code access list. If the emergency vehicle is not named in the high priority code access list, the preemption request is discarded at step 230, and the process returns to step 202 to process any further pending requests.

Once a preemption request has been found to be authorized (steps 212, 216, 228), and in proper circumstances had a priority adjustment (step 224), the process continues at step 226. At step 226, the direction of travel of the vehicle that submitted the preemption request is used in applying a directional priority to the preemption request. Directional priority preference is given to vehicles moving in a particular direction. For example, buses that are outbound from a city during an evacuation could be given preference over one heading inbound at the same time. At step 232, the preemption request is added to the set of preemption candidates, and the process returns to step 202 to process any further pending requests.

When there are no current preemption requests that have not already been added to the set of preemption candidates, decision step 202 directs the process to step 234. At step 234, any preemption candidate for which the lost timer indicates communication has been lost is removed from the set of preemption candidates. The status of each preemption candidate is checked. If there was not a request heard this second, the lost timer is incremented for the preemption request. If the lost timer exceeds a limit, the preemption candidate is removed.

At step 236, the set of preemption candidates is sorted by the categories of the requests. The set of preemption candidates is first sorted according to whether the preemption request is from an emergency vehicle (highest priority), from a transit vehicle for which the priority of the preemption request was raised to emergency, or from a transit vehicle for which the priority of the preemption request was not raised (lowest priority).

At step 238, the set of preemption candidates is further sorted by directional priority assigned to the preemption requests. At step 240 the set of preemption candidates is sorted within each directional priority such that the oldest request within each directional priority is the highest priority.

FIG. 3 shows the relationship between FIGS. 3-1, 3-2, and 3-3, which together form a flowchart of an example process for selecting one preemption candidate from multiple preemption candidates to preempt the traffic signal phase in accordance with an embodiment of the invention.

The process for selecting a preemption candidate considers a variety of factors in selecting a preemption candidate. Those factors include the relative priorities of the candidates, the relative times that the preemption requests were submitted, and the approaches of the preemption candidates relative to an in-progress preemption. The relative priorities are determined from a class code transmitted in the preemption request signal, and the process recognizes a superset of the class code ranges used in the different systems. For example, the OPTICOM light emitter-based system uses a class code range of 0 through 9, while the OPTICOM GPS system uses a class code range of 1 through 15. Additionally, the OPTICOM GPS system and compatible network based systems use an agency code to differentiate between agencies or jurisdictions. The agency code ranges in value from 1 through 254. The process recognizes a class code range of 0 through 15. Preemption requests with no agency code are assumed to have an agency code of 0. The combined set of class codes spans all agency codes so that vehicles using light-based emitters can compete with the same classes of vehicles from other agencies using GPS equipment.

Preemption candidates may be given preferential treatment based upon the class code. High priority vehicles typically used in public safety equipment may be separated by vehicle class such as police and fire or by vehicle type such as ladder truck and pumper. In cases where both types of vehicles are present, the one with a higher priority relative to the other may take precedence over it. For example, fire trucks could be given a higher priority relative to police cars.

The process generally selects a preemption candidate on a first come, first served basis from one or more preemption candidates having the highest priority. Preemption candidates may be given preferential treatment based upon the approach the vehicle is travelling on. The preference may be given based on traffic flow whereby vehicles such as transit buses may be given preference during morning rush hour when traveling inbound to a city. A second type of preference, commonly called call bridging, is given when multiple vehicles are approaching the intersection from different directions. In this case, the first vehicle to become in range gains preemption. As it travels through the intersection, preference is given to any other vehicles that are within range and on the same approach in order to reduce switching of phases of the traffic signal.

Referring now to FIG. 3-1, decision step 302 tests whether or not the set of preemption candidates 300 is empty. If so, the process is directed to decision step 304 to check whether or not a preemption request is in progress. An in-progress preemption request is a request for which the intersection preemption controller has activated and is maintaining a preemption request signal to the traffic signal controller. If there is no preemption in progress, the process returns to step 302. Otherwise, the process is directed to decision step 306, which checks whether or not the status of the in-progress preemption request is "holding." The hold status is used in combination with a hold timer. The hold timer is used to prevent an in-progress preemption request from being dropped too early, which without the hold timer could occur if a single broadcast is missed from the emitter/radio. The hold timer is also used to allow the vehicle time to clear the intersection at the end of the approach.

If the status of the in-progress preemption request is not holding, the status is changed to holding and the hold timer is started at step 308. The process then returns to step 302. If the status of the in-progress preemption request is holding decision step 310 checks whether or not the hold timer has expired. If not, the process returns to step 302. Otherwise, the preemption request is terminated and removed from the set of preemption candidates at step 312, with processing continuing at step 302.

If the set of preemption candidates is not empty, the process is directed to decision step 314 in FIG. 3-2. Decision step 314 checks whether or not there is a preemption request in progress. If so, decision step 316 checks whether or not the in-progress preemption request is also in the preemption candidate set. Note that a preemption candidate is removed from the set when it is terminated or the intersection preemption arrangement is no longer receiving a preemption request signal for that preemption candidate. If the in-progress preemption request is in the preemption candidate set, the process proceeds to check whether or not the status of the preemption request is holding at decision step 318. If the status is not holding, step 320 changes the status to holding and starts the hold timer. Otherwise, decision step 322 checks whether or not the hold timer has expired. While the hold timer has not expired, the process continues at decision step 324 to check if there are any preemption candidates having a higher priority than the in-progress preemption request. In an example embodiment, the class codes of the preemption candidates are used to determine priorities. For example, a lesser class code value may be used to indicate a higher priority and a greater class code value may indicate a lower priority. If there is a higher priority candidate, the in-progress preemption request is terminated at step 326, and the process continues at step 340 in FIG. 3-3.

If the hold timer for the in-progress preemption request has expired (decision step 322), decision step 328 checks whether or not there is any preemption candidate with an equal priority on the same approach as the in-progress preemption request. If not, the process continues at step 330 where the in-progress preemption request is terminated. If there is a preemption candidate with an equal priority on the same approach as the in-progress preemption request, the in-progress preemption request is terminated, and the oldest (based on the timestamp) equivalent priority preemption candidate is selected and made the in-progress preemption request at step 332. Note that the equivalence of priorities may vary according to implementation. For example, in one implementation the priority of preemption candidates may be equivalent only if the class codes are equal. In another embodiment, class code values within a group or range may be considered equivalent.

If the in-progress preemption candidate is in the set of preemption candidates (decision step 316), decision step 334 checks whether or not the status of the preemption request is holding. If not the process continues at step 324 as described above. Note that in step 326, if the terminated preemption request is in the set of preemption candidates, the termination further includes removing the preemption candidate from the set of preemption candidates. If the status of the preemption request is holding, decision step 336 checks whether or not the hold timer has expired. If not, the hold timer is cancelled as well as the hold status for the preemption request at step 338. The hold timer is used to allow a temporarily lost signal to be reacquired before the call is dropped. This provides some hysteresis around the signal acquisition for either noisy environments or weak signals. The reappearance of the preemption candidate causes the timer to be stopped to prevent dropping of the call. If the hold timer has expired, the in-progress preemption request is terminated and removed from the set of preemption candidates.

Continuing now at step 340 of FIG. 3-3, the process checks if any preemption candidate has a priority that indicates that the requesting vehicle is an emergency vehicle, for example, a fire or police vehicle. If there is such a candidate, the oldest one of those candidates is selected at step 342, and preemption is initiated for that preemption request at step 344. Depending on the phase of the traffic signal, initiating the preemption request may entail changing the signal to a green phase or extending the green phase of the traffic signal in the direction of the requesting emergency vehicle.

If there are no emergency class vehicles, decision step 346 checks whether any of the preemption requests are from transit vehicles and have had the priority raised to emergency priority. If there is such a candidate, the oldest one of those candidates is selected at step 348, and preemption is initiated for that preemption request at step 350. Depending on the phase of the traffic signal, initiating the preemption request may entail changing the signal to a green phase or extending the green phase of the traffic signal in the direction of the requesting transit vehicle.

If there are no transit class vehicles having had the priority raised, decision step 352 checks whether any of the preemption requests are from transit vehicles. If there is such a candidate, the oldest one of those candidates is selected at step 354, and preemption is initiated for that preemption request at step 356. Depending on the phase of the traffic signal, initiating the preemption request may entail extending the green phase of the traffic signal in the direction of the requesting transit vehicle or attempting a request for an early green phase. Whereas a preemption overrides the normal cycle of the controller to obtain the green phase regardless of which direction would normally next get the green phase, a request for an early green abbreviates the current cycle. With an early green request, the order of the control cycle stays the same. The direction that next receives the green phase is the direction that would have been next had an early green request not been submitted. The early green request reduces the time to receive the green phase in the desired direction.

At steps 344, 350, and 356, the selected preemption candidate is initiated by activating the preemption request signal for the associated approach to the intersection controller. The process then returns to step 302 in FIG. 3-1.

Figure 4:
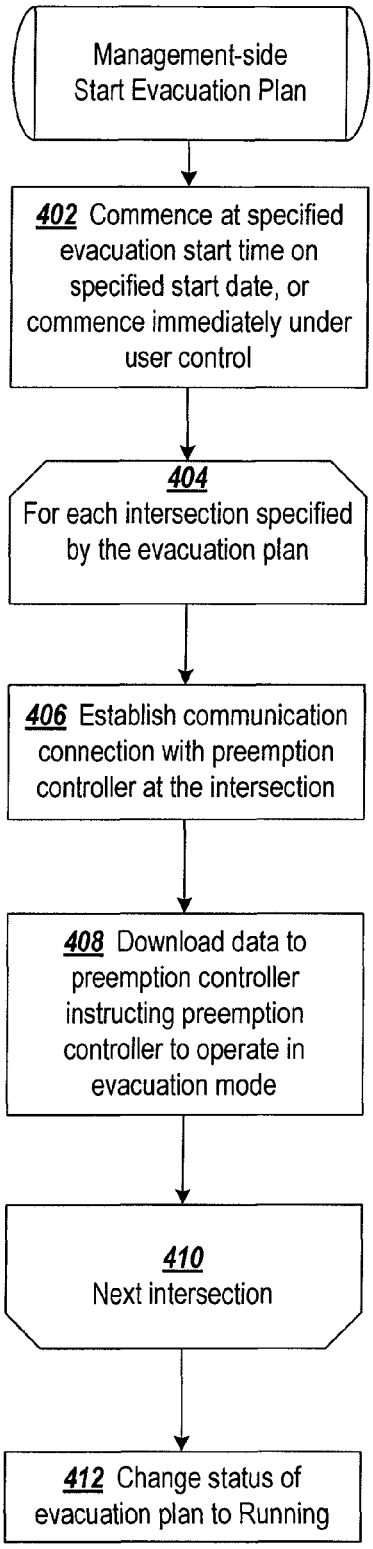
FIG. 4 is a flowchart of a process for starting an evacuation plan such as may be performed by a central management system.

FIG. 4 is a flowchart of a process for starting an evacuation plan such as may be performed by a central management system 120. As described further herein, a user may define one or more evacuation plans via the central management system. In various embodiments the evacuation plan data may specify those intersections for which the evacuation mode is to be activated, the direction for each intersection, start and stop dates and times for evacuation mode, and vehicle identifiers of those transit vehicles for which preemption may be granted.

The central management server is configured to process each evacuation plan on the specified start date and at the specified start time. At step 402, the process commences. An evacuation plan may be activated either automatically based on a programmed start date and start time or may be activated manually through selection by an operator. For each intersection specified by the evacuation plan (step 404), the process establishes a communication connection with the preemption controller at the intersection at step 406.

At step 408, configuration data are downloaded from the central management system 120 to the preemption controller. Based on the configuration data, the preemption controller begins to operate in evacuation mode. In one embodiment, the configuration data includes a value that indicates the duration for which evacuation mode is to be active, one or more vehicle identifiers, and the direction(s) for which preemption requests from transit vehicles will be allowed to preempt the phase of the traffic signal. In one embodiment, if communication cannot be established or evacuation mode cannot be set in the preemption controller, the central management system will retry to configure the preemption controller through the duration of the plan. The next intersection is processed beginning at step 410 and returning to step 406.

The status of the evacuation plan is set to Running at step 412. In one embodiment, an evacuation plan may be Pending, Running or Not Scheduled. The status may be conveyed to the user in a display screen (e.g., FIG. 7).

Figure 5:
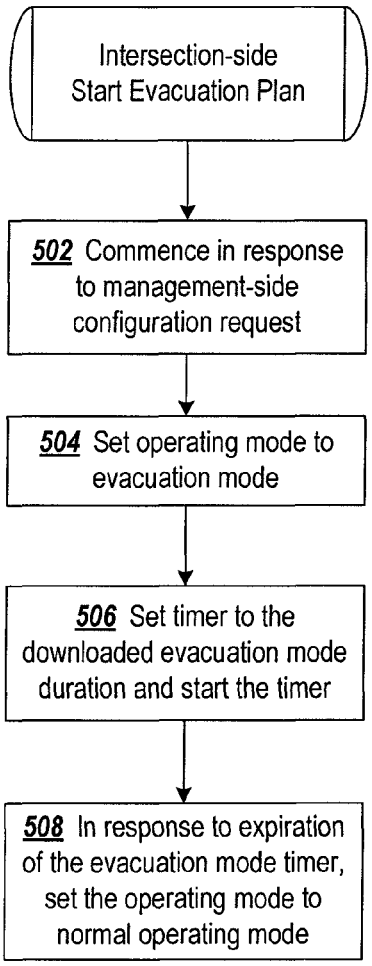
FIG. 5 is a flowchart of an example process performed by a preemption controller in response to a request to be configured to operate in evacuation mode.

FIG. 5 is a flowchart of an example process performed by a preemption controller in response to a request to be configured to operate in evacuation mode. The process begins in response to a configuration request from the central management system at step 502. The operating mode is set to evacuation mode at step 504, and at step 506 a timer is set and started to control the duration of the evacuation mode. The preemption controller continues to operate in evacuation mode until the timer expires, and at expiration of the timer, the operating mode reverts to normal operating mode at step 508.

Figure 6:
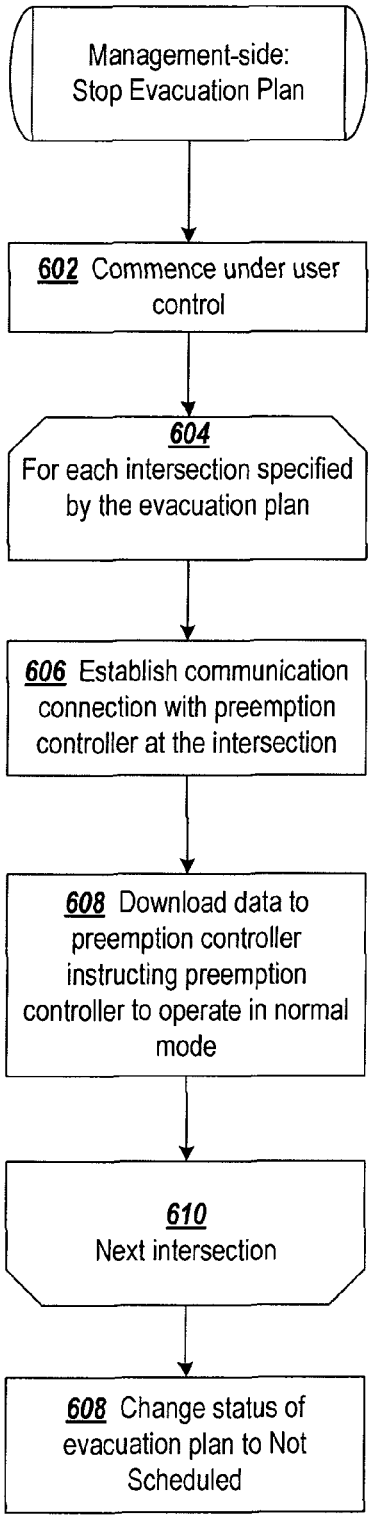
FIG. 6 is a flowchart of a process for stopping an evacuation plan.

FIG. 6 is a flowchart of a process for stopping an evacuation plan. One embodiment allows the user to override and stop a Running evacuation plan. FIG. 6 shows the process for stopping an evacuation plan. The process commences at step 602 in response to user input that directs the central management system to stop the running evacuation plan. For each intersection specified by the evacuation plan (step 604), the process establishes a communication with the preemption controller at the intersection at step 606 and downloads configuration data to the preemption controller at step 608. The configuration data instructs the preemption controller to operate in normal. At step 610, the next intersection is determined for processing by steps 606 and 608. The status of the evacuation plan is changed to Not Scheduled at step 608.

Figure 7:
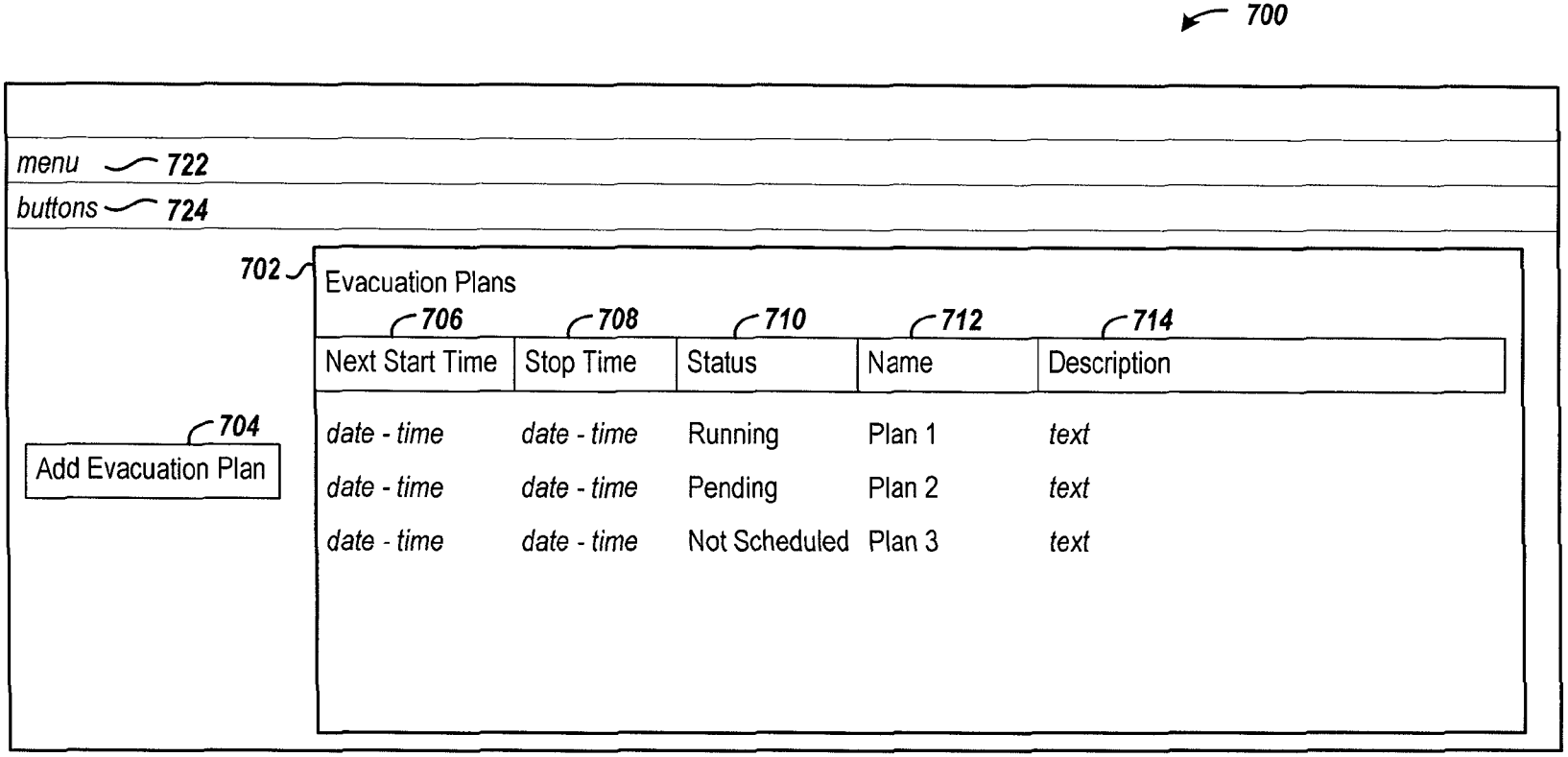
FIG. 7 shows an example user interface display window 700 for viewing and managing one or more evacuation plans.
Figure 8:
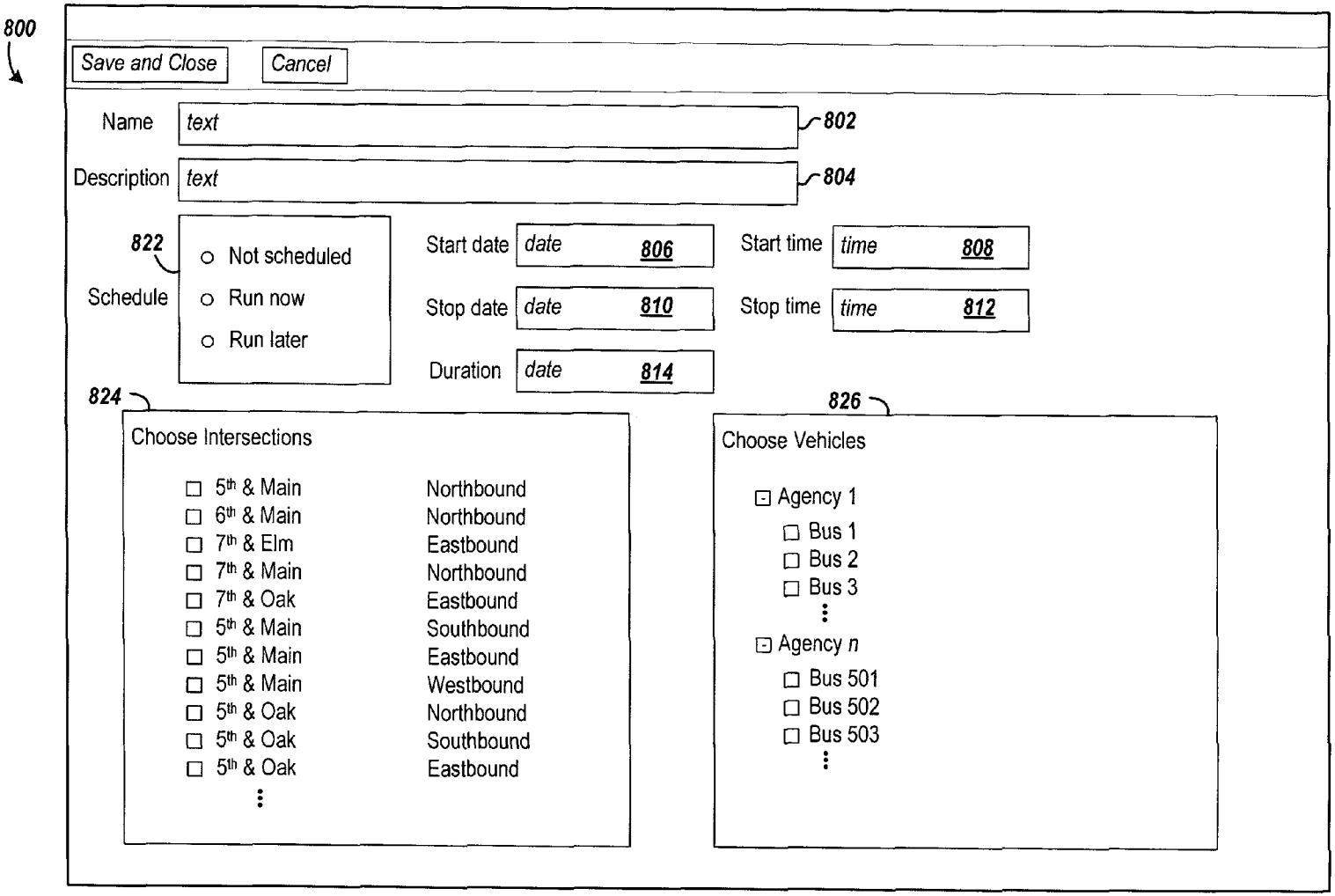
FIG. 8 shows an example user interface display window 800 for defining and editing an evacuation plan.

FIG. 7 shows an example user interface display window 700 for viewing and managing one or more evacuation plans. The set of defined evacuation plans is displayed in pane 702. A new evacuation plan may be defined by selecting button 704. FIG. 8 shows a user interface screen for defining an evacuation plan.

In one embodiment, the data displayed for each evacuation plan includes the Next Start Time 706, the Stop Time 708, the Status 710, the Name 712, and a textual description 714 of the evacuation plan. The Next Start Time is the date and time at which the evacuation plan will next start. The Stop Time is the date and time at which the evacuation plan will be stopped.

The Status of an evacuation plan may be Running, Pending, or Not Scheduled. An evacuation plan having a status of Running means that the intersections specified in the evacuation plan have been configured to operate in evacuation mode. An evacuation plan having a status of Pending means that the specified start time for the evacuation plan is in the future. An evacuation plan having a status of Not Scheduled means that there is no start time specified for the evacuation plan.

The menu 722 and buttons 724 may include an option for canceling an evacuation plan, which may be selected in the pane 702.

FIG. 8 shows an example user interface display window 800 for defining and editing an evacuation plan. The user interface includes text entry blocks 802 and 804 for entering the Name and Description of the evacuation plan, respectively.

The date and time at which the evacuation plan is to be started can be specified in blocks 806 and 808, respectively. The duration for which the evacuation plan is to be active may be specified either with the stop date and stop time blocks 810 and 812, respectively. Alternatively, the duration may be set in duration block 814. The dates and times may be specified with pull-down menus that display calendars and selectable times or specified via entry of date and time values.

Window pane 822 shows the defined schedule for the evacuation plan. If no start date and time are specified, the evacuation plan will be Not Scheduled. The user may select a Run now option to commence the evacuation plan when the plan is saved and the window 800 is closed. If a start date and start time have been specified, the Run later option will be automatically checked.

Window pane 824 displays a list of the intersections that may be selected for inclusion in the evacuation plan. In an example embodiment, there is a list entry for each direction of each intersection that may be included in an evacuation plan. Window pane 826 displays a list of vehicle identifiers for vehicles that may be included in an evacuation plan. In an example embodiment, the vehicles may be grouped according to the agency responsible for the vehicles. For example, there may be multiple entities running buses in a metropolitan area.

The present invention is thought to be applicable to a variety of systems for controlling the flow of traffic. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

What is claimed is:

1. A method for controlling a traffic signal phase at one or more intersections, respectively, comprising:

configuring a control system at an intersection to operate in one of a first mode or a second mode;

wherein the configuring of the control system to operate in the second mode includes storing data indicative of an evacuation direction;

while operating the control system in the first mode, in response to a transit priority signal received by the control system from a vehicle assigned transit priority, extending a green phase of the traffic signal in favor of the vehicle assigned transit priority; and while operating the control system in the second mode, in response to a transit priority signal received by the control system from the vehicle assigned transit priority, preempting a current non-green phase of the traffic signal to a green phase in favor of the vehicle assigned transit priority;

wherein the preempting of the current non-green phase of the traffic signal is denied to the vehicle assigned transit priority unless the vehicle assigned transit priority is traveling in the evacuation direction.

2. The method of claim 1, wherein while operating the control system in the second mode, in response to a transit priority signal received by the control system from the vehicle assigned transit priority, extending a current green phase of the traffic signal phase in favor of the vehicle assigned transit priority.

3. The method of claim 1, further comprising:

wherein the configuring of the control system to operate in the second mode includes storing one or more respective vehicle identifiers for one or more vehicles assigned transit priority; and while operating the control system in the second mode, in response to a transit priority signal received by the control system from a vehicle assigned transit priority and not having a stored vehicle identifier, continuing a current traffic signal phase without preempting a current non-green phase of the traffic signal phase.

4. The method of claim 1, wherein:

the configuring of the control system to operate in the second mode includes storing data indicating a start date and a stop date; and the preempting of the current non-green phase of the traffic signal is denied to the vehicle assigned transit priority unless the transit priority signal received by the control system is received between the start date and stop date.

5. The method of claim 4, wherein:

the configuring of the control system to operate in the second mode includes storing data indicating a start time and a stop time; and the preempting of the current non-green phase of the traffic signal phase is denied to the vehicle assigned transit priority unless the transit priority signal received by the control system is received between the start time and stop time.

6. The method of claim 1, wherein:

the configuring of the control system to operate in the second mode includes storing data indicative of the evacuation direction;

the preempting of the current non-green phase of the traffic signal is denied to the vehicle assigned transit priority unless the vehicle assigned transit priority is traveling in the evacuation direction; and in response to receiving an emergency priority signal by the control system from an emergency vehicle traveling in a direction other than the evacuation direction concurrent with receiving the transit priority signal from the vehicle assigned transit priority traveling in the evacuation direction, preempting a current non-green phase of the traffic signal to a green phase in favor of the emergency vehicle.

7. The method of claim 1, further comprising:

inputting evacuation plan data that specify one or more intersections to a centralized management system; and wherein the configuring includes the centralized management system configuring respective controllers at each of the one or more intersections to operate in the second mode.

8. The method of claim 7, wherein:

the evacuation plan data include a start date, a start time, a stop date, and a stop time;

the preempting of the current non-green phase of the traffic signal phase is denied to the vehicle assigned transit priority unless the transit priority signal received by the control system is received between the start time on the start date and the stop time on the stop date; and the configuring includes the centralized management system configuring respective controllers at each of the one or more intersections to operate in the second mode in response to passing of the start time on the start date.

9. The method of claim 8, wherein the configuring of each controller by the centralized management system includes downloading a duration value that specifies a period of time for which the controller is to operate in the second mode before reverting to the first mode.

10. The method of claim 8, further comprising the centralized management system configuring respective controllers at each of the one or more intersections to operate in the first mode in response to passing of the stop time on the stop date.

11. The method of claim 7, further comprising, in response to input to the centralized management system of a cancellation request that references the evacuation plan data, the centralized management system configuring respective controllers at each of the one or more intersections to operate in the first mode.

12. A system for controlling a traffic signal phase at an intersection, comprising:

a control system at an intersection configurable to operate in one of a first mode or a second mode;

wherein the control system is configurable to store data indicative of an evacuation direction;

two or more traffic signals coupled to the control system;

wherein the control system is configured to:

extend, in response to a transit priority signal received from a vehicle assigned transit priority while the control system is operating in the first mode, a green phase of one of the two or more traffic signals in favor of the vehicle assigned transit priority; and preempt, in response to a transit priority signal received by the control system from the vehicle assigned transit priority while the control system is operating the control system in the second mode, a current non-green phase of the one of the two or more traffic signals to a green phase in favor of the vehicle assigned transit priority;

wherein the control system is further configured to deny the preempting of the current non-green phase of the one of the two or more traffic signals to the vehicle assigned transit priority unless the vehicle assigned transit priority is traveling in the evacuation direction.

13. The system of claim 12, wherein the control system is further configured to extend, in response to a transit priority signal received by the control system from the vehicle assigned transit priority while the control system is operating in the second mode, a current green phase of the one of the two or more traffic signals in favor of the vehicle assigned transit priority.

14. The system of claim 12, wherein:

the control system is configurable to store one or more respective vehicle identifiers for one or more vehicles assigned transit priority; and the control system is further configured to continue, in response to a transit priority signal received by the control system from a vehicle assigned transit priority and not having a stored vehicle identifier while the control system is operating in the second mode, a current traffic signal phase without preempting a current non-green phase of the one of the two or more traffic signals.

15. The system of claim 12, wherein:

the control system is configurable to store data indicating a start date and a stop date; and the control system is further configured to deny the preempting of the current non-green phase of the one of the two or more traffic signals to the vehicle assigned transit priority unless the transit priority signal received by the control system is received between the start date and stop date.

16. The system of claim 15, wherein:

the control system is configurable to store data indicating a start time and a stop time; and the control system is further configured to deny the preempting of the current non-green phase of the one of the two or more traffic signals to the vehicle assigned transit priority unless the transit priority signal received by the control system is received between the start time and stop time.

17. The system of claim 12, wherein:

the control system is configurable to store data indicative of the evacuation direction;

the control system is further configured to deny the preempting of the current non-green phase of the one of the two or more traffic signals to the vehicle assigned transit priority unless the vehicle assigned transit priority is traveling in the evacuation direction; and the control system is further configured to preempt, in response to receiving an emergency priority signal by the control system from an emergency vehicle traveling in a direction other than the evacuation direction concurrent with receiving the transit priority signal from the vehicle assigned transit priority traveling in the evacuation direction, a current non-green phase of the one of the two or more traffic signals to a green phase in favor of the emergency vehicle.

18. A system for controlling traffic signal phases of a plurality of respective sets of two or more traffic signals at a plurality of intersections, comprising:

a management system;

a plurality of control systems at the plurality of intersections, respectively, each control system coupled to the management system and individually configurable via the management system to operate in one of a first mode or a second mode;

wherein each control system is coupled to one of the respective sets of two or more traffic signals, each control system is configurable to store data indicative of an evacuation direction, and each control system is configured to:

extend, in response to a transit priority signal received from a vehicle assigned transit priority while the control system is operating in the first mode, a green phase of one traffic signal of the respective set of two or more traffic signals in favor of the vehicle assigned transit priority; and preempt, in response to a transit priority signal received by the control system from the vehicle assigned transit priority while the control system is operating in the second mode, a current non-green phase of the one traffic signal of the respective set of two or more traffic signals to a green phase in favor of the vehicle assigned transit priority, deny the preempting of the current non-green phase of the one of the two or more traffic signals to the vehicle assigned transit priority unless the vehicle assigned transit priority is traveling in the evacuation direction.

19. The method of claim 1, further comprising, while operating the control system in the first mode, in response to the transit priority signal received by the control system from the vehicle assigned transit priority, not preempting the current non-green phase of the traffic signal to a green phase in favor of the vehicle assigned transit priority.

20. The system of claim 12, wherein the control system is further configured to not preempt, in response to the transit priority signal received by the control system from the vehicle assigned transit priority while the control system is operating in the first mode, the current non-green phase of the one traffic signal of the respective set of two or more traffic signals to a green phase in favor of the vehicle assigned transit priority.

21. The system of claim 18, wherein each control system is further configured to not preempt, in response to the transit priority signal received by the control system from the vehicle assigned transit priority while the control system is operating in the first mode, the current non-green phase of the one traffic signal of the respective set of two or more traffic signals to a green phase in favor of the vehicle assigned transit priority.

* * * * *